US005538365A

United States Patent [19]

Seim, II et al.

[11] Patent Number: 5,538,365

[45] Date of Patent: Jul. 23, 1996

[54] TWO-PRESSURE, PNEUMATIC CONVEYING SYSTEM FOR ROD-LIKE ARTICLES WITH PARTIAL AIR VENTING

[75] Inventors: Albert D. Seim, II; Herman J. Steinbuchel, IV; Clive W. Watson, all of Richmond, Va.

[73] Assignee: Molins PLC, Milton Keynes, United Kingdom

[21] Appl. No.: 199,945

[22] Filed: Feb. 22, 1994

[30] Foreign Application Priority Data

Feb. 19, 1993 [GB] United Kingdom ..... 9303384

[51] Int. Cl.[6] ..... B65G 51/02

[52] U.S. Cl. ..... 406/14; 406/19; 406/63; 406/84; 131/282

[58] Field of Search ..... 406/10, 12, 19, 406/62, 63, 65, 67, 68, 72, 83, 84, 191, 194, 14; 131/282, 283

[56] References Cited

U.S. PATENT DOCUMENTS 4,059,310 11/1977 Waskiewicz et al. ..... 406/65 X
4,740,113 4/1988 Hirose et al. ..... 406/70

FOREIGN PATENT DOCUMENTS 1070340 6/1967 United Kingdom .

*Primary Examiner*—Andrew C. Pike
*Attorney, Agent, or Firm*—Antonelli, Terry, Stout & Kraus

[57] ABSTRACT

In a pneumatic filter rod conveying system a vent (12) is in the line (10) close to the distributor (2). This enables a relatively high pressure gradient to be established, with resultant high filter transfer rates at the distributor, without having excessively high pressures in the distributor and/or higher than necessary line transmission speeds. Also, there may be a selectable pressure switch (40) for reducing air pressure at the distributor when there are fewer than normal filters in the line, e.g., at the end of a run: this also allows avoidance of undesirably high line transmission speeds.

15 Claims, 2 Drawing Sheets

TWO-PRESSURE, PNEUMATIC CONVEYING SYSTEM FOR ROD-LIKE ARTICLES WITH PARTIAL AIR VENTING

This invention relates to a pneumatic conveying system for rod-like articles, particularly cigarette filter rods for use in manufacturing filter cigarettes.

In the tobacco industry it is common to convey cigarette filter rods pneumatically from the vicinity of a machine at which the filter rods are produced to a filter cigarette assembling machine, at which individual filters are united with tobacco lengths to form filter cigarettes. Commonly filter rods are supplied to a pneumatic transmission line at a distributor unit having a hopper for filter rods and a number of lines which receive rods from the hopper by way of one or more rotors which convey filters from the hopper to the entrance to the line. In one known arrangement rods are received from the hopper in a delivery rotor and conveyed to a position at which they are transferred to a discharge rotor, the latter subsequently conveying the rods to a position in alignment with a transmission line and at which the rods are pneumatically transferred into and through the line. Such an arrangement is disclosed in British patent specification No. 1209898, to which reference is directed for further details.

According to a first aspect of the present invention a pneumatic conveying system for rod-like articles includes a distributor at which successive rod-like articles may be conveyed to a discharge position, and means for pneumatically transferring articles from said position into a transmission line through which the articles may be transmitted pneumatically to a relatively remote receiver, wherein means is provided relatively close to the distributor for venting at least a proportion of the air used to initiate movement of the articles from the discharge position. In a preferred arrangement the distributor includes a rotor and the discharge position is an angular position of the rotor. The rotor may have a plurality of chambers, each capable of containing a rod-like article. The venting means may comprise a variable restrictor, so as to control the pressure difference between positions upstream and downstream of the venting means. Means may be provided for sensing the pressure upstream and downstream of the venting means.

By providing a vent (or pressure relief) relatively close to the distributor the invention enables the establishment of a relatively high pressure gradient at the distributor, with resultant high air and filter rod velocity, which is important for transfer from the distributor to the transmission line at high rates (e.g., 2000 articles/minute or more) and can be advantageous at lower rates, particularly when conveying heavy filter rods or some types of rod of unusual construction. In the absence of venting means relatively close to the distributor the provision of a high pressure gradient at the distributor would require higher pressure at the distributor, which could result in sealing and/or back-pressure problems, and would result in higher article speeds in the line than are necessary or desirable. In this respect it should be noted that a high transfer acceleration and resultant speed at the distributor are desirable, particularly when the rods are conveyed transversely (e.g., in a rotor) to the discharge position, in order to achieve a high transfer rate, but that such high speeds are not required in the transmission line.

According to another aspect of the invention a pneumatic conveying system for rod-like articles includes a distributor at which successive rod-like articles may be conveyed to a discharge position, means for pneumatically transferring articles from said position into a transmission line along which the articles are transmitted pneumatically to a relatively remote receiver, and means for supplying pressure air for conveying articles along the transmission line, said supplying means including selectable means for supplying air either at a first pressure or at a second pressure which is lower than said first pressure. Preferably said selectable means is operable to supply said second pressure when there are fewer articles than normal in the transmission line, e.g., after the last article in a run has entered the line. The selectable means need not supply air at only two discrete pressures: it could include proportional pressure or flow control (with or without feedback) to vary the air flow. Preferably the selectable means is linked to means for sensing when there are or will be fewer articles in the line. The sensing means may detect the end of a run, e.g., by sensing the last article to enter the line. The sensing means could be responsive to passage of articles at or adjacent the distributor, and could respond to gaps between articles. The selectable means may comprise a switching arrangement for connecting the transmission line to a source at said first pressure or a source at said second pressure.

By supplying a lower pressure when there are fewer articles in the line undesirable and/or excessive increase in speed of the articles, which would otherwise occur, can be avoided. If the conveyance speed of the articles in the line is too high, damage and/or malfunction at the receiver can occur.

The different aspects of the invention may be embodied in a common system.

The invention will be further described, by way of example only, with reference to the accompanying diagrammatic drawings, in which.

Figure 1:
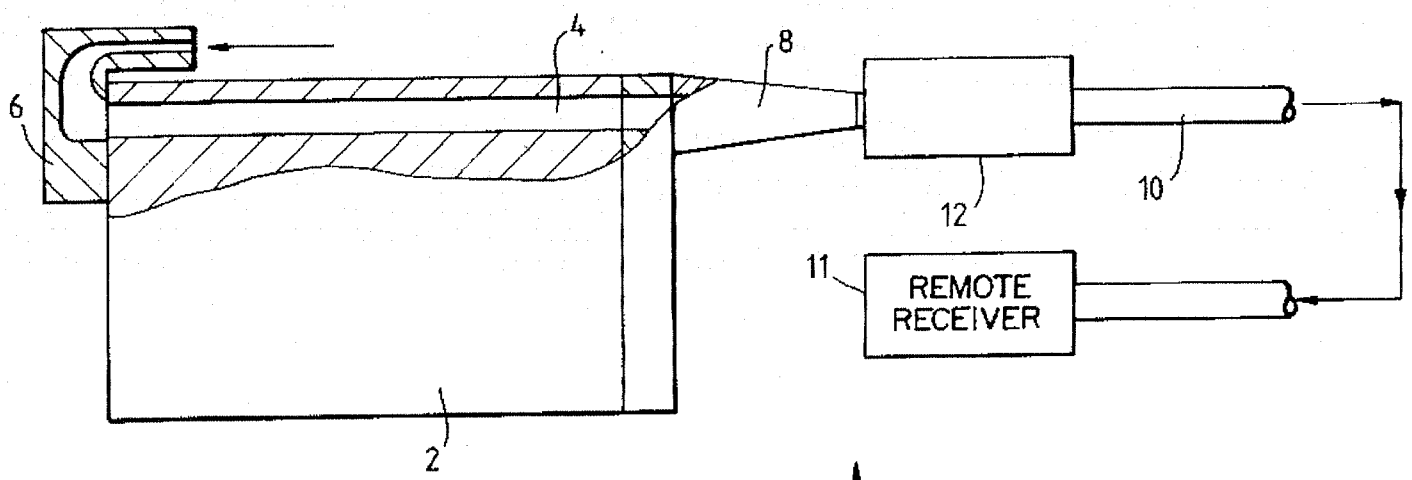
FIG. 1 is a part-sectional side view of part of a pneumatic distributor.

FIG. 1 shows part of a pneumatic distributor unit which is generally similar to that disclosed in said specification No. 1209898. The unit has a rotor 2 having a plurality of chambers 4, only one of which is shown in the drawing, arranged in a ring around its axis. Each chamber 4 receives a filter rod from a delivery rotor (not shown) at a first rotational position of the rotor 2 and conveys it to a second rotational position at which the chamber is aligned with a line air seal 6 at which pressure air is applied to one end of the chamber. As may be seen from the drawing, in which the chamber 4 is in said second position, the other end of the chamber is aligned in that position with a transfer tube 8 which in turn leads to a transmission tube 10.

The rotor 2 rotates continuously: as each chamber 4 passes the line air seal 6 the air pressure causes the filter rod contained in the chamber to be pneumatically transferred through the transfer tube 8 and into the transmission tube 10. The tube 8 has an inlet end which is widened in the direction of rotation of the rotor 2, in order to accommodate the initial transverse movement of the transferred rod. The pressure air supplied to the tubes 8 and 10 with each successive filter rod causes the rods to be conveyed through the tube 10.

The distributor unit is arranged to receive filter rods from a filter rod making machine (not shown) and is therefore conveniently located adjacent such a machine. The transmission tube 10 leads to a receiver unit 11 located at a filter cigarette assembling machine (not shown). Each distributor unit may contain a plurality of rotors 2 each supplying a transmission tube 10. Commonly two transmission tubes lead to each receiver unit. Typically the receiver units are located up to 300 meters from the distributor unit. An example of a system of this type currently available is the APHIS System, of Molins PLC.

Figure 2:
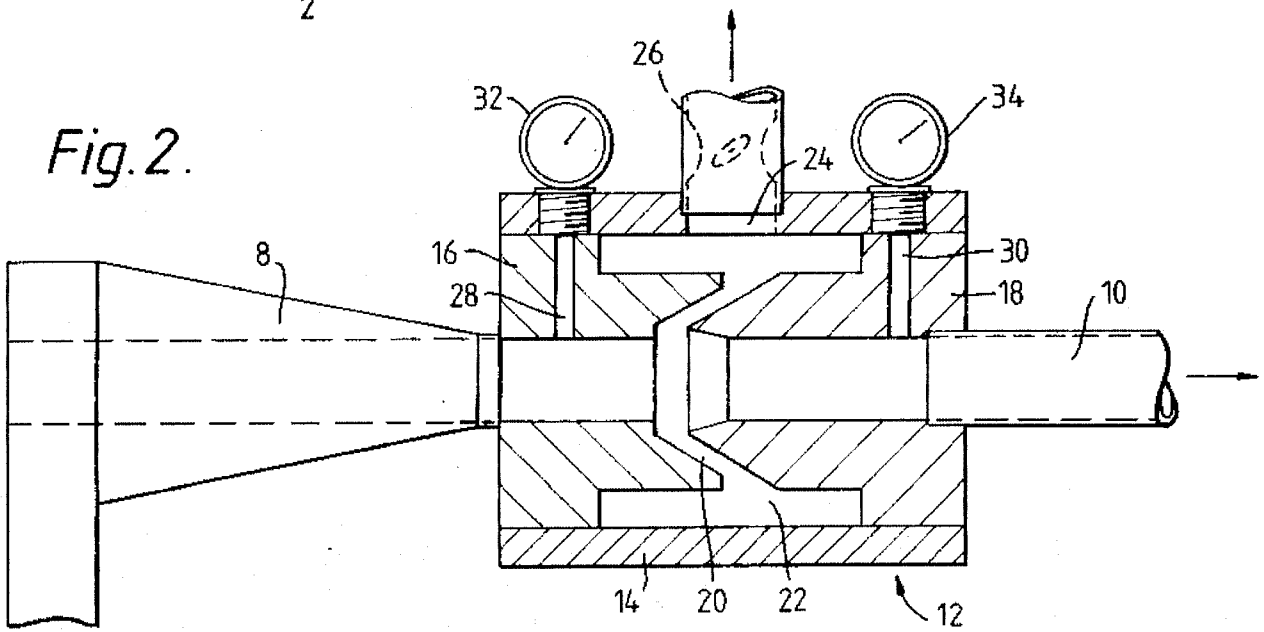
FIG. 2 is an enlarged part-sectional side view of part of the distributor shown in FIG. 1.

Interposed between the transfer tube 8 and the suction tube 10 is a venting device 12, which provides a path for rods and in effect constitutes a connection between the tubes 8 and 10. The device 12, which is shown in more detail in FIG. 2, comprises a cylindrical housing 14 having a first end plug 16 at one end, connected to the transfer tube 8, and a second end plug 18 at the other end, connected to the transmission tube 10. An annular passageway 20 between the plugs 16 and 18 allows pressure air from the chamber 4 into an annular chamber 22 within the housing 14. An orifice 24 in the housing 14 connects the chamber 22 to atmosphere via a variable restrictor 26, which vents a portion of the air in the chamber 22. Bores 28, 30 in the housing 14 and plugs 16 and 18 respectively connect pressure transducers 32, 34 to the tubes 8 and 10.

In operation, pressure air is applied to the line air seal 6, typically at 30 psi (20,000 Pa) to initiate movement of an article from the discharge position in chamber 4. The variable restrictor 26 is adjusted to vent a portion of the air in the chamber 22 so that the pressure in the transmission tube 10, as sensed by the transducer 34, is typically 8–15 psi (55,000 to 105,000 Pa). The reduced pressure in the transmission tube 10 provides sufficient pressure gradient, although lower than the pressure gradient in the transfer tube 8, to ensure an adequate flow rate of rods in the tube. Accordingly, the rate of flow of conveying air is relatively high for transfer of articles from the chamber 4 to the line 10, but is lower for conveyance of articles through the transmission line 10. The higher pressure at the distributor ensures sufficient transfer speed, even when the rotor 2 is revolving at high speed. Thus, the venting by the variable restrictor 26 is operable to allow transfer of articles between the rotor 2 and the line 10 at a first velocity and transmission of the articles along the line 10 downstream of the venting device 12 at a second velocity which is lower than the first velocity.

Figure 3:
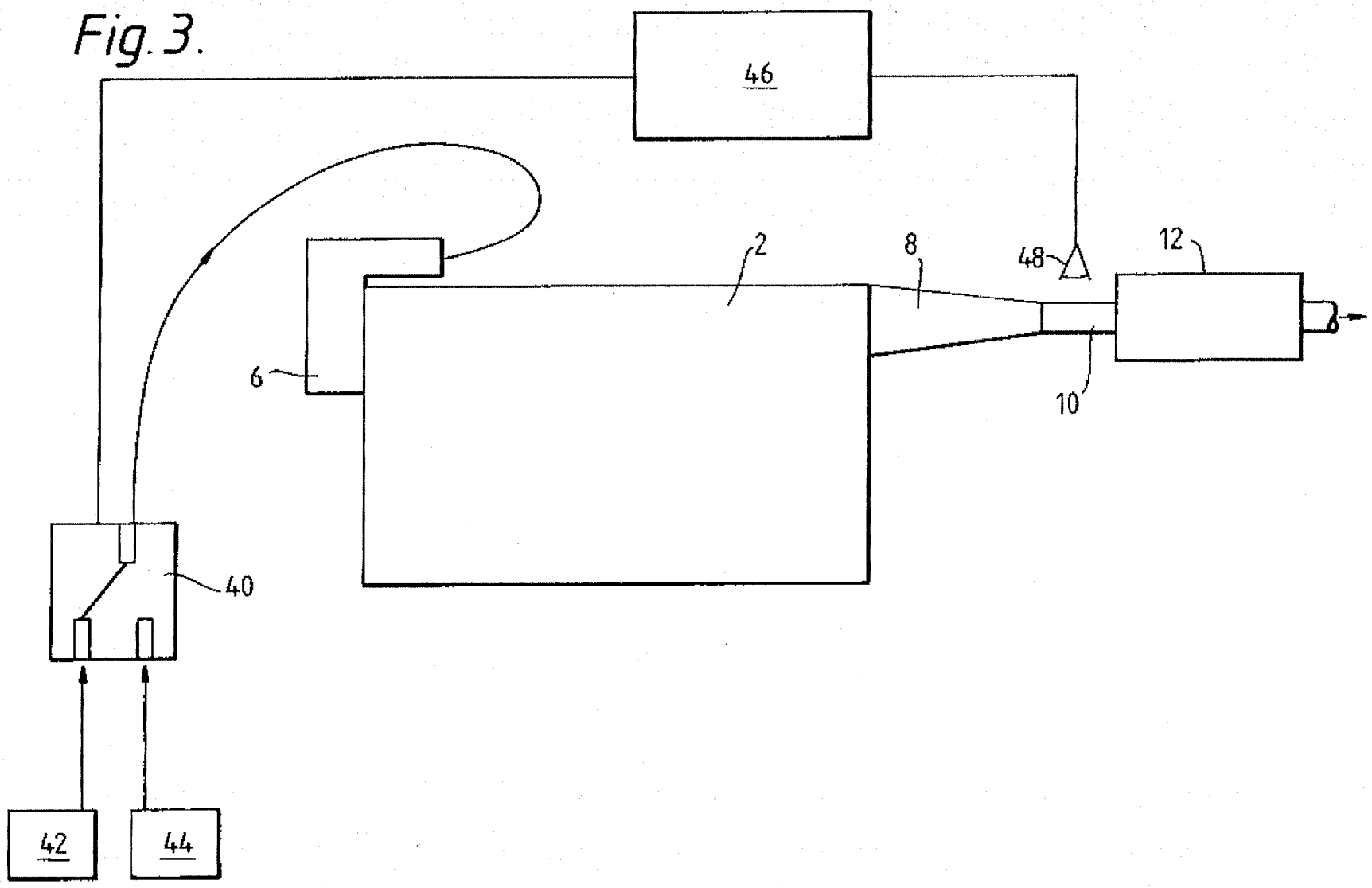
FIG. 3 is a side view of part of a modified pneumatic distributor.

FIG. 3 shows a distributor unit which is similar to that of FIG. 1. Similar reference numbers have been used for similar parts. The line air seal 6 is connected to a switch 40 at which the seal may be connected to a source 42 of air at normal pressure (e.g., 30 psi) or to a source 44 of air at lower pressure (e.g., 15 psi). The switch 40 is actuated by means including a control circuit 46 connected to a sensor 48, which detects gaps between successive rods. The circuit 46 responds to increased gaps, i.e., indicating fewer rods in the tube 10 such as may occur at the end of a run, and causes the switch 40 to connect the source 44 to the line air seal. By applying a lower pressure when there are fewer rods in the tube 10 the speeds of the rods are maintained at acceptable levels.

We claim:

1. A pneumatic conveying system for rod-like articles including a distributor at which successive rod-like articles may be conveyed to a discharge position, and means for pneumatically transferring said articles from said discharge position into a transmission line through which articles may be transmitted pneumatically to a relatively remote receiver, wherein means is provided relatively close to the distributor for venting at least a proportion of air used to initiate movement of the articles from the discharge position.

2. A system as claimed in claim 1, wherein the venting means comprises a variable restrictor.

3. A system as claimed in claim 1, including means for sensing pressure upstream and downstream of the venting means.

4. A system as claimed in claim 1, wherein the distributor includes a rotor and the discharge position is an angular position of the rotor, wherein said venting means is operable to allow transfer of said articles between said rotor and said line at a first velocity and transmission of said articles along said line downstream of said venting position at a second velocity, said second velocity being lower than said first velocity.

5. A pneumatic conveying system for rod-like articles including a distributor at which successive rod-like articles may be conveyed to a discharge position, means for pneumatically transferring said articles from said discharge position into a transmission line along which the articles are transmitted pneumatically to a relatively remote receiver, sensing means for detecting the spacing between said articles passing from said distributor into said line, and means for supplying pressure air for conveying said articles along the transmission line, said supplying means including selectable means responsive to said sensing means for supplying air either at a first pressure or at a second pressure which is lower than said first pressure depending upon a detected spacing between said articles.

6. A system as claimed in claim 5, wherein said selectable means includes means operable to supply air at said second pressure when a rate of passage of said articles in the line is lower than a predetermined rate.

7. A system as claimed in claim 5, further including control means responsive to said sensing means for determining when there are or will be fewer than a predetermined number of said articles passing from said distributor to said line and for controlling said selectable means to supply air at said second pressure in response thereto.

8. A system as claimed in claim 7, wherein the sensing means includes means responsive to passage of said articles at or adjacent the distributor.

9. A system as claimed in claim 5, wherein the selectable means includes a switching arrangement for connecting the transmission line to a source at said first pressure or a source at said second pressure.

10. A pneumatic conveying system for rod-like articles including a distributor at which successive rod-like articles may be conveyed to a discharge position, means for pneumatically transferring said articles from said discharge position into a transmission line along which the articles are transmitted pneumatically to a relatively remote receiver, means for sensing when there are or will be fewer than a predetermined number of said articles in the line, and means for supplying pressure air for conveying said articles along the transmission line, said supplying means including selectable means linked to said sensing means for supplying air either at a first pressure or at a second pressure which is lower than said first pressure, wherein the sensing means includes means for detecting the last article in a group of said articles to be transmitted through the line.

11. A method of pneumatically conveying rod-like articles including the steps of conveying successive articles in a direction transverse to the lengths thereof to a discharge position, conveying said articles in an axial direction from said discharge position along a pneumatic transmission line by means of conveying air introduced at or adjacent said discharge position, establishing a first pressure air gradient to convey said articles from said discharge position into a first portion of said transmission line provided relatively close to said discharge position, and establishing a second pressure air gradient, which is lower than said first pressure air gradient, in a second portion of said transmission line, which is downstream of said first portion, by venting at least a proportion of said conveying air at a position in said transmission line which is relatively close to said discharge position between said first portion and said second portion, whereby the rate of flow of said conveying air is relatively high for transfer of said articles from said discharge position into said transmission line, but is lower for conveyance of said articles in said second portion of said transmission line.

12. A method of pneumatically conveying rod-like articles including the steps of conveying successive articles in a direction transverse to the lengths thereof to a discharge position, conveying said articles in an axial direction from said discharge position along a pneumatic transmission line by means of conveying air introduced at or adjacent said discharge position, providing sources of said conveying air at first and second pressures, said first pressure being higher than said second pressure, determining the rate or expected rate of conveyance of said articles in said transmission line by detecting the spacing between said articles passing from said discharge position into said line, supplying conveying air from said source at said first pressure when said rate or expected rate is higher than a predetermined rate, and supplying said conveying air from said source at said second pressure when said rate or expected rate is lower than said predetermined rate, whereby the conveyance speed of said articles in said transmission line is maintained at an acceptable level when said rate is lower than said predetermined rate.

13. A method as claimed in claim 12, wherein said determining step includes monitoring the rate of passage of said articles at or adjacent said discharge position.

14. A method as claimed in claim 12, wherein said determining step includes detecting that the frequency of introduction of said articles into the transmission line has or will be reduced.

15. A method as claimed in claim 12, wherein said determining step includes detecting the last article in a group of said articles to be transmitted through said line.

* * * * *